US008319704B2

(12) United States Patent
Lee et al.

(10) Patent No.: US 8,319,704 B2
(45) Date of Patent: Nov. 27, 2012

(54) PLASMA DISPLAY AND DRIVING METHOD THEREOF

(75) Inventors: Myoung-Kyu Lee, Suwon-si (KR); Kazuhiro Ito, Suwon-si (KR); Yoo-Jin Song, Suwon-si (KR); Tae-Wook Kim, Suwon-si (KR)

(73) Assignee: Samsung SDI Co., Ltd., Gyeonggi-Do (KR)

( * ) Notice: Subject to any disclaimer, the term of this patent is extended or adjusted under 35 U.S.C. 154(b) by 806 days.

(21) Appl. No.: 12/215,944

(22) Filed: Jun. 30, 2008

(65) Prior Publication Data

US 2009/0002278 A1 Jan. 1, 2009

(30) Foreign Application Priority Data

Jun. 29, 2007 (KR) ..... 10-2007-0065349

(51) Int. Cl.
*G09G 3/28* (2006.01)

(52) U.S. Cl. ..... 345/60; 345/62

(58) Field of Classification Search ..... 345/60
See application file for complete search history.

(56) References Cited

U.S. PATENT DOCUMENTS

| | | | | |
|---|---|---|---|---|
| 6,888,518 | B2 * | 5/2005 | Roh et al. | 345/68 |
| 2003/0174105 | A1 * | 9/2003 | Kanazawa | 345/63 |
| 2004/0085263 | A1 * | 5/2004 | Lee et al. | 345/41 |
| 2005/0099364 | A1 * | 5/2005 | Jung et al. | 345/60 |
| 2005/0116887 | A1 * | 6/2005 | Lee et al. | 345/60 |
| 2006/0049758 | A1 * | 3/2006 | Min | 313/582 |
| 2007/0013615 | A1 * | 1/2007 | Kim et al. | 345/66 |
| 2007/0091027 | A1 * | 4/2007 | Kwak | 345/68 |
| 2007/0200800 | A1 * | 8/2007 | Choi et al. | 345/68 |

OTHER PUBLICATIONS

Figure 7 Illustration.pdf.*

* cited by examiner

*Primary Examiner* — Alexander S Beck
*Assistant Examiner* — Mihir Rayan
(74) *Attorney, Agent, or Firm* — Knobbe Martens Olson & Bear, LLP

(57) ABSTRACT

A plasma display device, which gradually increases the current to the panel capacitors is disclosed. The display uses an inductor to reduce the current spike which would otherwise occur and create large electromagnetic interference.

13 Claims, 4 Drawing Sheets

PLASMA DISPLAY AND DRIVING METHOD THEREOF

CROSS-REFERENCE TO RELATED APPLICATION

This application claims priority to and the benefit of Korean Patent Application No. 10-2007-0065349 filed in the Korean Intellectual Property Office on Jun. 29, 2007, the entire contents of which are incorporated herein by reference.

BACKGROUND

1. Field

The field relates to a plasma display device and a driving method thereof.

2. Description of the Related Technology

A plasma display device is a display device using a plasma display panel for displaying characters or images by using plasma generated by a gas discharge.

The plasma display device drives by dividing a frame into a plurality of subfields each having a weight value, and displays a grayscale by a combination of weight values of subfields in which a display operation is generated among the plurality of subfields.

A plurality of light emitting cells are initialized during a reset period of each subfield, and light emitting cells and non-light emitting cells among the plurality of light emitting cells are selected by an address discharge during an address period of each subfield.

Each light emitting cell is sustain discharged during a sustain period of each subfield so that images are displayed.

In general, to initialize a wall charge during the reset period, after a voltage of a scan electrode is gradually increased to a predetermined voltage (e.g., Vset voltage), the voltage of the scan electrode is gradually decreased to a predetermined voltage (e.g., Vnf voltage). While the voltage of the scan electrode is gradually decreased, a positive voltage is applied to a sustain electrode by turning on a switch that is connected between a power source for supplying a positive voltage and a sustain electrode. However, when the switch is turned on, much current flows to the sustain electrode, and significant electromagnetic interference (EMI) is generated.

The above information disclosed in this Background section is only for enhancement of understanding of the background of the invention and therefore it may contain information that does not form the prior art that is already known in this country to a person of ordinary skill in the art.

SUMMARY OF CERTAIN INVENTIVE EMBODIMENTS

One aspect is a plasma display including a first electrode, a second electrode, an inductor connected with the first electrode, and a first switch connected between the inductor and a first power source configured to supply a first voltage. The display also includes a second switch connected between the second electrode and a second power source configured to supply a second voltage, and a controller configured to turn on the first switch during a first period within an address period, to turn on the second switch during a second period within the address period, and to turn off the first switch while the second switch is turned on and when a resonance current in the inductor has a value other than a maximum value.

Another aspect is a method of driving a plasma display device including a plurality of first electrodes and a plurality of second electrodes. The method includes, during a first period of an address period, applying a first voltage to the plurality of first electrodes through a switch and an inductor connected in series between a first power source for supplying a first voltage to the plurality of first electrodes. The method also includes sequentially applying a scan pulse to the plurality of second electrodes during the first period, applying a second voltage that is lower than the first voltage to the plurality of second electrodes during a second period, applying a third voltage that is higher than the second voltage to the plurality of second electrodes during the second period, where the second period is consecutive to the first period, and turning off the switch while the second switch is turned on and when a resonance current in the inductor has a value other than a maximum value.

Another aspect is a plasma display including a plurality of panel capacitors including a plurality of first electrodes and a plurality of second electrodes, and a first driver including an inductor connected with the plurality of first electrodes and a first switch connected between the inductor and a first power source for supplying a first voltage. The display also includes a second driver including a second switch connected between the plurality of second electrodes and a second power source for supplying a second voltage that is lower than the first voltage, where an address period includes a first period and a second period, the second period being consecutive to the first period, where the second driver is configured to sequentially apply a scan pulse to the plurality of second electrodes during the first period, and to turn on the second switch during the second period, and where the first driver is configured to turn on the first switch during the first period, and to turn off the first switch when current in the inductor has a value other than a maximum or minimum value.

DETAILED DESCRIPTION OF CERTAIN INVENTIVE EMBODIMENTS

Figure 1:
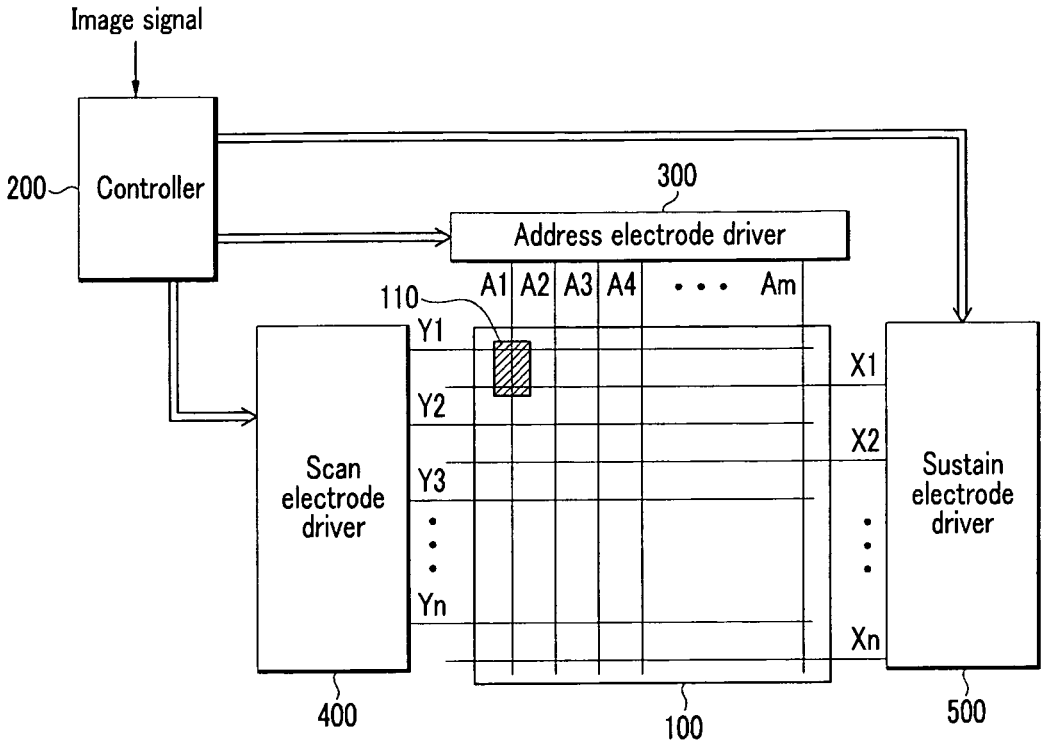
FIG. 1 is a schematic drawing showing a plasma display device according to an exemplary embodiment.

In the following detailed description, certain exemplary embodiments have been shown and described, simply by way of illustration. As those skilled in the art would realize, the described embodiments may be modified in various ways, without departing from the spirit or scope of the present invention. Accordingly, the drawings and description are to be regarded as illustrative in nature and not restrictive. Like reference numerals generally designate like elements throughout the specification.

Throughout this specification and the claims that follow, when it is described that an element is "coupled" to another element, the element may be "directly coupled" to the other element or "coupled" to the other element through a third element.

In some embodiments, a wall charge is a charge formed close to each electrode on the wall of a cell, for example a dielectric layer. Although the wall charges do not actually touch the electrodes, the wall charges will be described as being "formed" or "accumulated" on the electrode. Also, a wall voltage is a potential difference formed at the wall of a cell by wall charges.

A weak discharge is a discharge that is weaker than a sustain discharge in a sustain period and an address discharge in an address period.

Embodiments of the plasma display device and driving methods thereof according to some exemplary embodiments will now be described in detail.

FIG. 1 is a drawing showing a plasma display device according to an exemplary embodiment.

As shown in FIG. 1, a plasma display device includes a plasma display panel 100, a controller 200, an address electrode driver 300, a scan electrode driver 400, and a sustain electrode driver 500.

The plasma display panel 100 includes a plurality of address electrodes A1-Am (referred to as "A electrodes" hereinafter) extending in a column direction, and a plurality of sustain electrodes X1-Xn (referred to as "X electrodes" hereinafter) and a plurality of scan electrodes Y1-Yn (referred to as "Y electrodes" hereinafter) extending in a row direction, in pairs. In general, the X electrodes X1-Xn are formed to correspond to the respective Y electrodes Y1-Yn, and the X electrodes X1-Xn and the Y electrodes Y1-Yn perform a display operation during a sustain period in order to display an image. The Y electrodes Y1-Yn and the X electrodes X1-Xn are disposed to cross the A electrodes A1-Am. A discharge space present at each crossing area of the A electrodes A1~Am and the X and Y electrodes X1~Xn and Y1~Yn forms discharge cells 110.

The structure of the PDP 100 shows one example, and a panel with a different structure can be applied with driving waveforms described herein.

The controller 200 receives a image signal from the outside and outputs an A electrode driving control signal, an X electrode driving control signal, and a Y electrode driving control signal. Further, the controller 200 drives a frame by dividing it into a plurality of subfields each having a weight value. Each subfield includes a reset period, an address period, and a sustain period.

The address electrode driver 300 receives the A electrode driving control signal from the controller 200 and applies a driving voltage to the A electrodes.

The scan electrode driver 400 receives the Y electrode driving control signal from the controller 200 and applies a driving voltage to the Y electrodes.

The sustain electrode driver 500 receives the X electrode driving control signal from the controller 200 and applies a driving voltage to the X electrodes.

Figure 2:
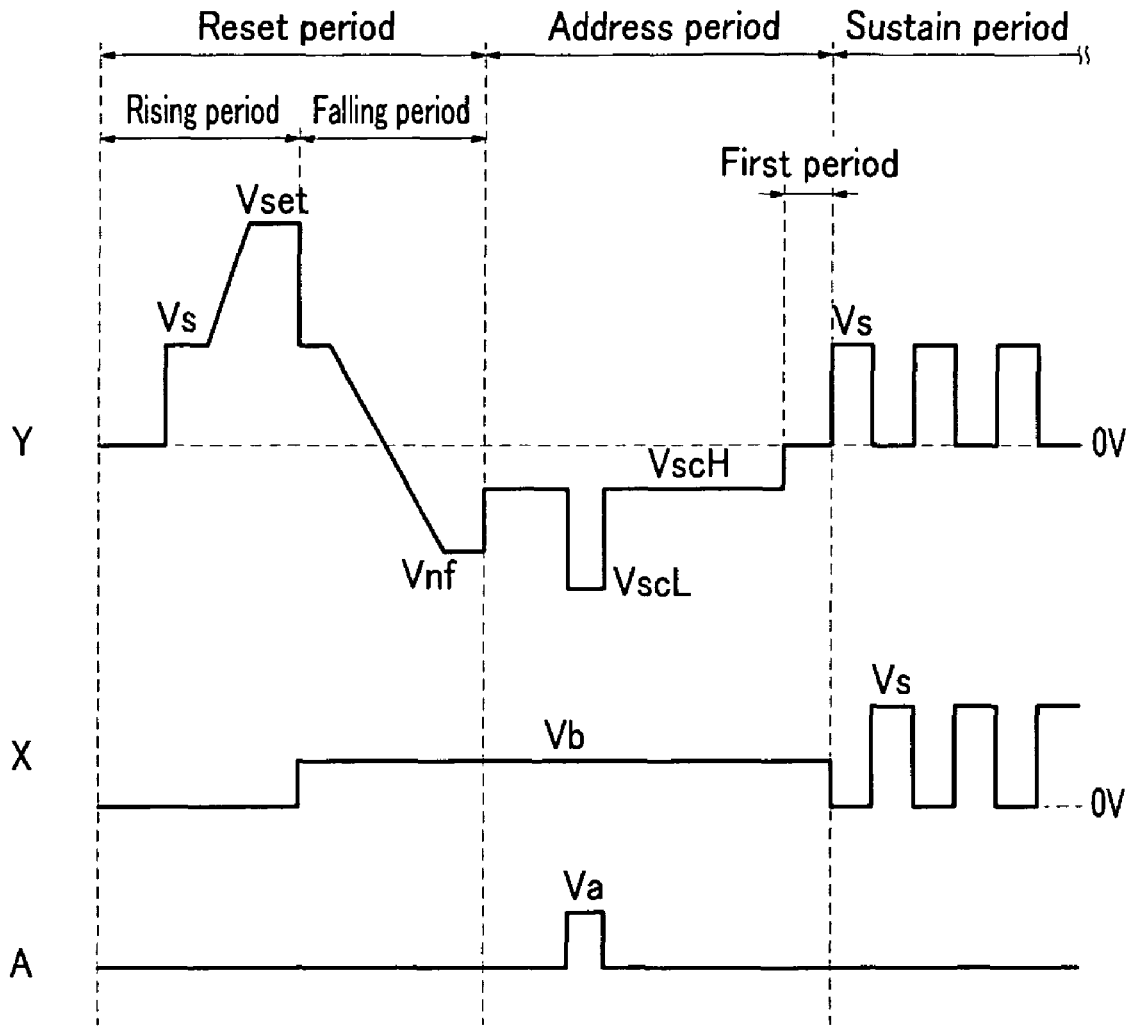
FIG. 2 is a timing drawing showing a driving waveform of the present invention according to an exemplary embodiment.

FIG. 2 is a timing drawing showing a driving waveform according to an exemplary embodiment.

In FIG. 2, the driving waveform will be described with a cell formed by an A electrode, an X electrode, and a Y electrode as a reference.

As shown in FIG. 2, in a rising period of the reset period, the sustain electrode driver 500 and the address electrode driver 300 bias the X electrode and the A electrode to a reference voltage (0V in FIG. 2), respectively, and the scan electrode driver 400 gradually increases the voltage of the Y electrode from a voltage Vs to a voltage Vset. In FIG. 2, the voltage of the Y electrode is shown to increase in a ramp pattern, but a different voltage waveform that is gradually increased may alternatively be applied to the Y electrode. Then, while the voltage of the Y electrodes is increasing, a weak discharge occurs between the Y and X electrodes and between the Y and A electrodes, forming negative (−) wall charges in the Y electrodes and positive (+) wall charges in the X and A electrodes.

At this time, the Vset voltage may be larger than a discharge firing voltage between the X electrode and the Y electrode in order to induce discharge at all cells.

In a falling period of the reset period, the sustain electrode driver 500 biases the X electrode with a voltage Vb, and the scan electrode driver 400 gradually decreases the voltage of the Y electrode from the voltage Vs to a voltage Vnf. Then, while the voltage of the Y electrodes is decreasing, a weak discharge occurs between the Y and X electrodes and between the Y and A electrodes, erasing the negative (−) wall charges formed in the Y electrodes and the positive (+) wall charges formed in the X and A electrodes.

In general, the voltage of Vb and the voltage of Vnf may be set so that the wall voltage between the Y electrode and the X electrode is near 0V in order to prevent a misfiring discharge in a non-light emitting cell. That is, a voltage of (Vb-Vnf) is set to be close to the discharge firing voltage between the Y electrode and the X electrode.

In the address period, in order to select a light emitting cell, the sustain electrode driver 500 maintains the voltage of the X electrode to the voltage Vb, and the scan electrode driver 400 and the address electrode driver 300 apply a scan pulse having the VscL voltage and an address pulse having the Va voltage to the Y electrode and the A electrode, respectively.

The scan electrode driver 500 applies a non-selected Y electrode with the voltage VscH that is higher than the voltage of VscL, and the address electrode driver 300 applies the A electrode of a non-light emitting cell with the reference voltage.

At this time, the voltage VscL may be equal to the voltage Vnf, or the voltage VscL may be lower than the voltage Vnf.

In more detail, in the address period, the scan electrode driver 400 and the address electrode driver 300 apply scan pulses to the Y electrode (Y1 in FIG. 1) of a first row and at the same time apply address pulses to the A electrodes positioned at light emitting cells in the first row.

Then, address discharges occur between the Y electrodes (Y1 in FIG. 1) of the first row and the A electrodes to which the address pulses have been applied, forming positive (+) wall charges in the Y electrode (Y1 in FIG. 1) and negative (−) wall charges in the A and X electrodes.

Subsequently, while the scan electrode driver 400 applies scan pulses to the Y electrode (Y2 in FIG. 1) of a second row, the address electrode driver 300 applies address pulses to the A electrodes positioned at light emitting cells of the second row.

Then, address discharges occur at cells formed by the A electrodes to which the address pulses have been applied and the Y electrode (Y2 in FIG. 1) of the second row, forming wall charges in the cells.

Likewise, while the scan electrode driver 400 sequentially applies scan pulses to the Y electrodes of the remaining rows, the address electrode driver 300 applies address pulses to the A electrodes positioned at light emitting cells to form wall charges.

The scan electrode driver 500 applies the reference voltage to the Y electrode during a first period after the scan pulses are sequentially applied to the plurality of Y electrodes (Y1-Yn in FIG. 1) within the address period.

In the sustain period, the scan electrode driver 400 applies the sustain pulse alternately having a high level voltage (Vs in FIG. 2) and a low level voltage (0V in FIG. 2) to the Y electrodes a number of times corresponding to a weight value of the corresponding subfield.

In addition, the sustain electrode driver 500 applies a sustain pulse to the X electrodes in a phase opposite to that of the sustain pulse applied to the Y electrodes. That is, 0V is applied to the X electrode when a VS voltage is applied to the Y electrode, and the VS voltage is applied to the X electrode when 0V is applied to the Y electrode.

In this case, the voltage difference between the Y electrode and the X electrode alternately has a Vs voltage and a −Vs voltage. Accordingly, the sustain discharge repeatedly occurs at light emitting cells as many times as the predetermined number.

Figure 3:
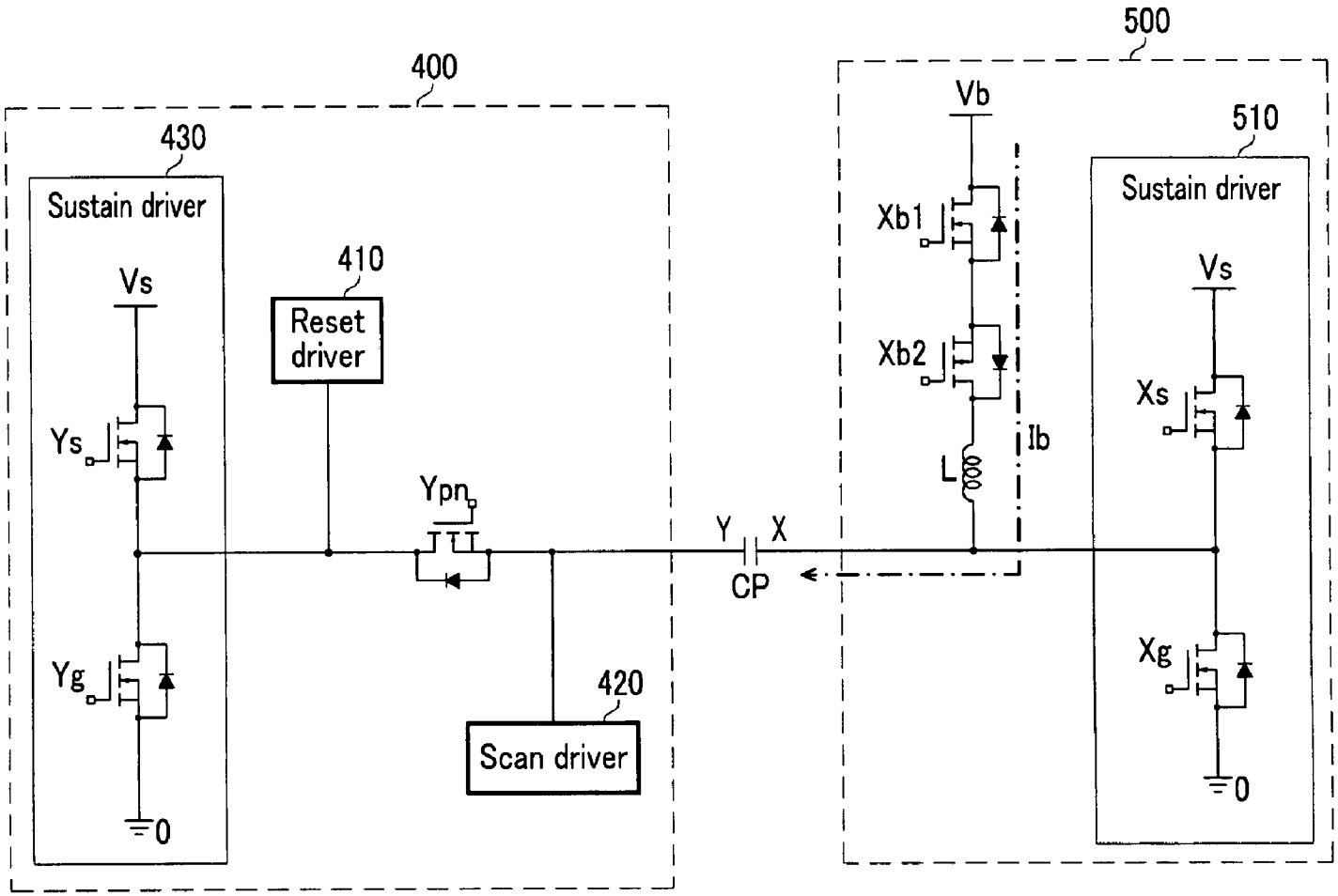
FIG. 3 is a schematic drawing showing a driving circuit according to an exemplary embodiment.
Figure 4:
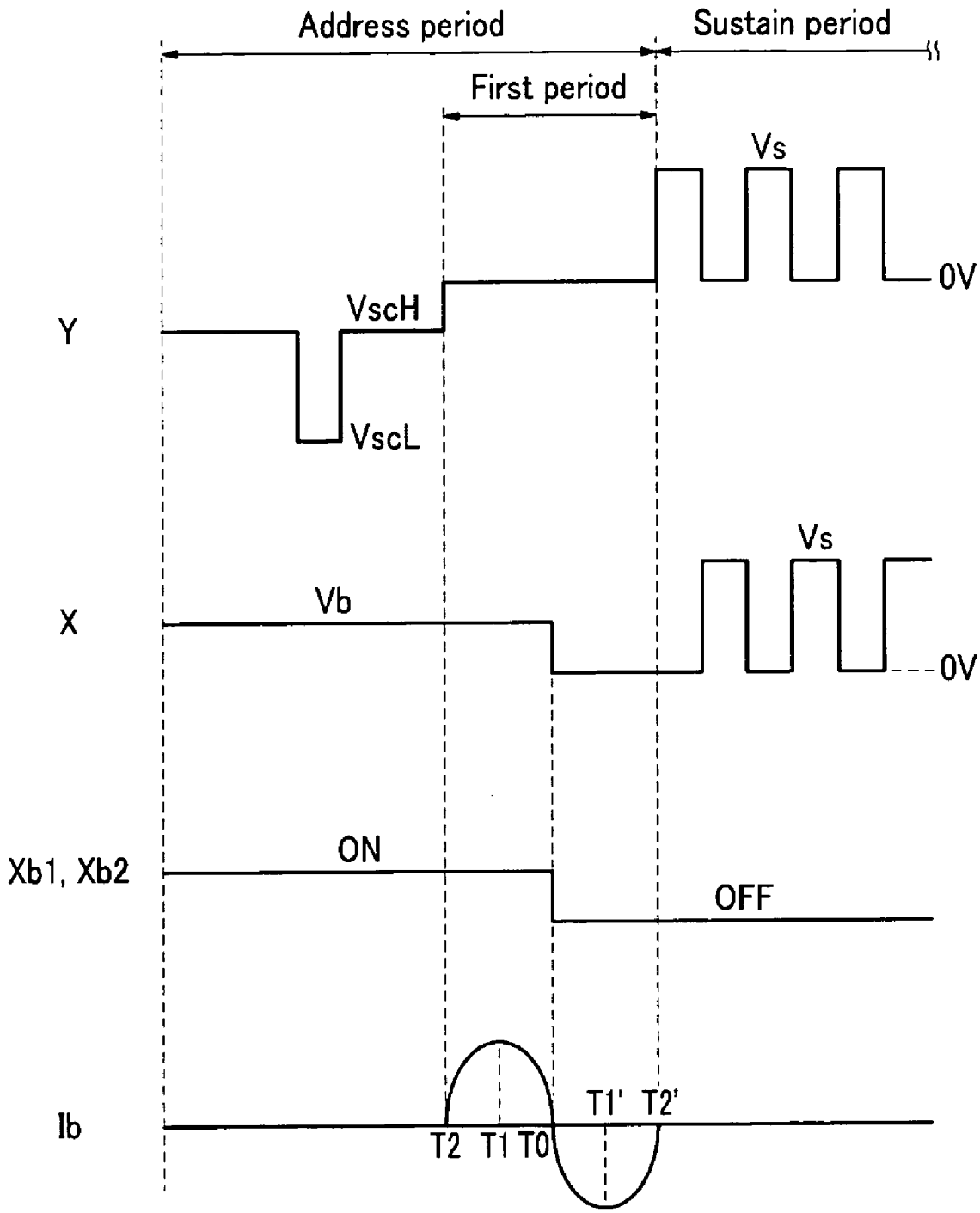
FIG. 4 is a timing drawing showing timing of turning off two transistors Xb1 and Xb2 in FIG. 3.

FIG. 3 is a drawing showing a driving circuit according to an exemplary embodiment, and FIG. 4 is a drawing showing timing of turning off of two transistors Xb1 and Xb2 in FIG. 3.

FIG. 3 shows a capacitive component formed by the single Y electrode and a single X electrode as a panel capacitor Cp. Further, FIG. 3 illustrates switches as n-channel metal oxide semiconductor (NMOS) transistors having a body diode. Other transistors that can perform a similar function may be used for the switches.

The scan electrode driver 400 includes a reset driver 410, a scan driver 420, a sustain driver 430, and a transistor Ypn. The sustain electrode driver 500 includes a sustain driver 510, transistors Xb1 and Xb2, and an inductor L.

As shown in FIG. 3, the reset driver 410 is connected with the Y electrode, and applies a rising reset waveform and a falling reset waveform to the Y electrode during the reset period.

The scan driver 420 is connected with the Y electrode, and selectively applies the voltage VscL and the voltage VscH to the Y electrode during the address period.

The sustain driver 430 includes transistors Ys and Yg. A contact of the two transistors Ys and Yg is connected with the Y electrode. The sustain driver 430 applies the sustain pulses to the Y electrode during the sustain period.

A drain of the transistor Ypn is connected to the node between the transistor Ys and the transistor Yg, and a source of the transistor Ypn is connected to the scan driver 420. The transistor Ypn cuts off a current path formed by the ground terminal 0 and the scan driver 420 when the voltage VscL is applied to the Y electrode during the address period.

Next, the sustain driver 510 includes transistors Xs and Xg. A contact of the two transistors Xs and Xg is connected with the X electrode. The sustain driver 510 applies the sustain pulses to the X electrode during the sustain period.

The inductor L is connected between the X electrode and a power source Vb for supplying the voltage Vb, and two transistors Xb1 and Xb2 are connected between the inductor L and the power source Vb. A source of the transistor Xb1 is connected with a source of the transistor Xb2. Meanwhile, a drain of the transistor Xb1 may be connected with a drain of the transistor Xb2. That is, two transistors Xb1 and Xb2 are connected in series. Further, in some embodiments, one switch may be used instead of the two transistors Xb1 and Xb2, or a diode may be used instead of the transistor Xb2 to cut off a current path formed by a body diode of the transistor Xb1.

The sustain electrode driver 500 turns on the two transistors Xb1 and Xb2 during the falling period of the reset period and the address period to apply the voltage Vb to the X electrode. At this time, without the inductor L, much current flows to the sustain electrode when the two transistors Xb1 and Xb2 are turned on, and a large electromagnetic interference (EMI) is generated. However, with the inductor L between the power source Vb and the X electrode, the driving circuit according to the exemplary embodiment prevents large instantaneous currents. As a result the EMI is reduced greatly.

Next, as shown in FIG. 4, in the first period of the address period, the sustain electrode driver 500 maintains the turned on state of the two transistors Xb1 and Xb2, and the scan electrode driver 400 turns on the transistors Yg and Ypn. As a result, the voltage of the Y electrode is changed from the voltage VscH to the ground voltage 0V. A resonance is then induced between the inductor L and the panel capacitor Cp by changing the voltage of Y electrode, and a resonance current Ib flows. That is, as shown in FIG. 4, the resonance current Ib begins to be induced at a point of time T2 in which the voltage of the Y electrode is changed from the voltage VscH to the voltage 0V.

When the transistors Xb1 and Xb2 are turned off while the resonance current Ib flows, a voltage of the contact between the inductor L and the transistor Xb2 is increased. Particularly, since energy of the inductor L has the maximum value at a points of time T1 and T1' having a maximum value of the resonance current Ib. When the transistors Xb1 and Xb2 are turned off at times T1 and T1', the voltage of the contact between the inductor L and the transistor Xb2 is further increased. Thus, internal voltage of the transistor Xb2 is increased, and stress of the transistor Xb2 is increased.

As shown in FIG. 4, the sustain electrode driver 400 according to an exemplary embodiment turns off transistors Xb1 and Xb2 in a point of time excluding a point of time in which the resonance current Ib is the maximum value, that is, at one-quarter or three-quarters of a resonance cycle T1 and T1'. The resonance cycle is determined by the panel capacitor Cp and the inductor L.

In this case, since the energy of the inductor L is less than the energy of the inductor L when the resonance current is the maximum value, the voltage of the contact may be reduced, and the stress of the transistor Xb2 is also reduced. Particularly, when the transistors Xb1 and Xb2 turn off at a point of time T0 or T2' at which time the resonance current is 0, that is, half of the resonance cycle, or the time corresponding to a constant multiple of the resonance cycle, the internal voltage and the stress of the transistor Xb2 may be further increased.

In addition, the sustain electrode driver 400 turns on the transistor Xg when the transistors Xb1 and Xb2 are turned off, to apply the reference voltage 0V to the X electrode.

While this invention has been described in connection with what is presently considered to be practical exemplary embodiments, it is to be understood that the invention is not limited to the disclosed embodiments, but, on the contrary, is intended to cover various modifications and equivalent arrangements included within the spirit and scope as understood by one of ordinary skill in the art.

What is claimed is:

1. A method of driving a plasma display device including a plurality of first electrodes and a plurality of second electrodes, the first and second electrodes forming panel capacitors of the display, the method comprising:

during a first period of an address period, applying a first voltage to the plurality of first electrodes through a first switch and an inductor connected between a first power source for supplying the first voltage to the plurality of first electrodes;

sequentially applying a scan pulse to the plurality of second electrodes during the first period;

applying a second voltage during the first period to second electrodes that are not receiving the scan pulse during the first period;

applying a third voltage that is higher than the second voltage through a second switch, the second switch connected between the second electrodes and a second power source for supplying the second voltage to the plurality of second electrodes during a second period of the address period, wherein the second period is consecutive to the first period; and turning off the first switch when a resonance current in the inductor has a value other than a maximum value during the second period of the address period.

2. The plasma display of claim 1, wherein the first electrodes comprise sustain electrodes.

3. The plasma display of claim 1, wherein the second electrodes comprise scan electrodes.

4. The method of claim 1, further comprising:

applying a fourth voltage that is higher than the second voltage to one of the second electrodes that is not receiving the second voltage during the first period, wherein the fourth voltage is lower than the third voltage.

5. The method of claim 1, wherein the resonance current when the first switch is turned off is substantially equal to 0.

6. The plasma display of claim 1, wherein the first switch comprises first and second transistors connected in series between the first power source and the inductor.

7. A plasma display comprising:

a plurality of panel capacitors comprising a plurality of first electrodes and a plurality of second electrodes;

a first driver including an inductor connected with the plurality of first electrodes, and a first switch connected between the inductor and a first power source for supplying a first voltage; and a second driver including a second switch connected between the plurality of second electrodes and a second power source for supplying a second voltage that is lower than the first voltage, wherein an address period includes a first period and a second period, the second period being consecutive to the first period, wherein the second driver is configured to sequentially apply a scan pulse to the plurality of second electrodes during the first period, to apply a second voltage during the first period to second electrodes that are not receiving the scan pulse, and to apply a third voltage that is higher than the second voltage to the plurality of second electrodes during a second period of the address period, wherein the first driver is configured to turn on the first switch during the first period, and to turn off the first switch when current in the inductor has a value other than a maximum or minimum value during the second period of the address period.

8. The plasma display of claim 7, wherein the first electrodes comprise sustain electrodes.

9. The plasma display of claim 7, wherein the second electrodes comprise scan electrodes.

10. The plasma display of claim 7, wherein the second driver is configured to turn off the first switch when the current in the inductor is substantially equal to 0.

11. The plasma display of claim 10, wherein the first driver further includes a third switch connected to the second power source and the plurality of second electrodes, and the first driver turns on the third switch after the first switch is turned off during the second period.

12. The plasma display of claim 10, wherein the second driver further includes a third switch connected between a third power source for supplying a third voltage that is higher than the second voltage and the plurality of second electrodes, and the second driver alternately turns on the second switch and the third switch during a sustain period.

13. The plasma display of claim 7, wherein the first switch comprises first and second transistors connected in series between the first power source and the inductor.

* * * * *